US005902184A

United States Patent [19]

Bennett

[11] Patent Number: 5,902,184

[45] Date of Patent: May 11, 1999

[54] SLOT MACHINE GAME WITH DYNAMIC SCORECARD

[75] Inventor: Nicholas Luke Bennett, Manly Vale, Australia

[73] Assignee: Aristocrat Leisure Industries Pty Ltd., Rosebery, Australia

[21] Appl. No.: 08/875,138

[22] PCT Filed: Jan. 19, 1996

[86] PCT No.: PCT/AU96/00025

§ 371 Date: Jul. 18, 1997

§ 102(e) Date: Jul. 18, 1997

[87] PCT Pub. No.: WO96/22586

PCT Pub. Date: Jul. 25, 1996

[30] Foreign Application Priority Data

Jan. 19, 1995 [AU] Australia ..... PN 0639

[51] Int. Cl.[6] ..... G07F 17/34

[52] U.S. Cl. ..... 463/13; 463/20; 463/25; 273/143 R

[58] Field of Search ..... 273/143 R, 138.2, 273/138 A; 463/12, 13, 20, 25

[56] References Cited

U.S. PATENT DOCUMENTS

| | | | |
|---|---|---|---|
| 5,393,061 | 2/1995 | Manship et al. | 273/143 R |
| 5,542,669 | 8/1996 | Charron et al. | 463/13 |

FOREIGN PATENT DOCUMENTS

| | | |
|---|---|---|
| 77590 | 1/1975 | Australia . |
| 21918/88 | 9/1988 | Australia . |
| 3207868 | 9/1983 | Germany . |
| 4400488 | 7/1995 | Germany . |
| 4404009 | 7/1995 | Germany . |
| 4405879 | 8/1995 | Germany . |
| 4411831-A1 | 10/1995 | Germany . |

*Primary Examiner*—Benjamin H. Layno
*Attorney, Agent, or Firm*—Venable; Norman N. Kunitz

[57] ABSTRACT

A slot machine of the type having a plurality of rotatable reels carrying symbols is arranged to pay a variable prize on the occurrence of a predetermined symbol or combination of symbols. The top box on top of the slot machine displays the various winning combinations for which a prize is paid and in particular includes a display window in which is displayed a variable prize value associated with the special winning symbol or symbol combination.

32 Claims, 5 Drawing Sheets

32
33
777
RED, WHITE
OR BLUE 7
IN ANY POSITION
ON CENTRE LINE
RANGE 100-300
CREDITS 34
20
7
31
30
30

SLOT MACHINE GAME WITH DYNAMIC SCORECARD

The present invention relates to gaming machines of the type known as slot machines or fruit machines having a series of rotatable reels each displaying a series of symbols or a video simulation of such a mechanism as well as machines arranged to play a game of poker and in particular the invention provides an improvement to a game played on such a machine.

Players who regularly play gaming machines quickly tire of particular games and therefore it is necessary for manufacturers of these machines to come up with innovative game features that add interest to the games provided on such machines in order to keep the players amused and therefore willing to continue playing the game.

DESCRIPTION OF THE PRIOR ART

Gaming or poker machines have been well known in the state of New South Wales for many years and have more recently gained considerable popularity throughout Australia, with quite substantial amounts of money wagered on these machines. There is a growing tendency for State governments to legalise the use of gaming machines by licensing operators, with resulting revenue gains through licence fees and taxation of monies invested. The licensed operation of gaming machines is the subject of State legislation and regulation. This regulation most always dictates a maximum percentage payout for a gaming machine. For example, a maximum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons. Therefore, gaming machine manufacturers are keen to devise games which are popular with players, as a mechanism for improving sales.

Many various strategies have been tried in the past to make games more enticing to players, including the commonly known double-up feature, whereby, if a player wins a particular game, they can then risk the winnings of that game in a double-or-nothing mode in which they gamble on a subsequent, and often different, game such as whether a red or black card will be the next card drawn.

Other techniques adopted in the past have been to provide complexity in the numbering and combinations of indicia which would result in a win, thereby hoping to convince the player that there is a greater chance of winning and to keep their interest in a particular game.

SUMMARY OF THE INVENTION

The present invention consists of a gaming machine having display means, and game control means arranged to control images displayed on the display means, the game control means being arranged to play a game wherein a plurality of symbols are randomly selected and displayed on the display means and, if a winning combination results, the machine pays a prize, the game being characterised in that the gaming machine is provided with variable prize display means arranged to display a value of a variable prize the value being within a predetermined range, and when a predetermined symbol or combination of symbols is displayed, the control means selects and displays a variable prize value within the predetermined range and the gaming machine pays the selected prize.

The present invention is applicable to gaming machines of the traditional poker machine style (also known as slot machines or fruit machines) in which the display means comprises a set of rotatable reels, each carrying a plurality of symbols, or a video simulation thereof. The invention is equally applicable to videodraw poker machines in which a poker hand is displayed on the screen, the cards of the hand being selected from a standard 52 or 53 card deck.

In one embodiment of the invention, the variable prize is paid when a particular symbol is displayed in the pay line, such as one of a red 7, white 7 or a blue 7. In other embodiments, the variable prize is paid for a particular combination such as a three of a kind, five of a kind, straight, flush or any other predetermined combination. The variable prize may be selected by the machine from a fixed range such as 100 to 300 credits or alternatively the range may be selectable by the player in which case the player may be offered the choice of a number of possible ranges such as 0–1000 credits; 200–800 credits; 300–700 credits; 400–600 credits; or 450–550 credits. In the player selectable arrangement the player may take the risk of a low payout in exchange for the possibility of a high payout or alternatively he may opt for a guaranteed middle range payout.

In embodiments of the invention which employ rotating reels as the display device, an auxiliary display is required to display the variable prize value. This may take the form of a liquid crystal display built into the score card artwork. In the case of a video machine, the variable prize value is preferably displayed on the video screen when the winning symbol or combination is displayed.

BRIEF DESCRIPTION OF THE DRAWINGS

An embodiment of the invention will now be described, by way of example with reference to the accompanying drawings, in which.

DETAILED DESCRIPTION OF THE PREFERRED EMBODIMENTS

In the following detailed description the methodology of the embodiments will be described, and it is to be understood that it is within the capabilities of the non-inventive worker in the art to introduce the methodology on any standard microprocessor-based gaming machine by means of appropriate programming.

Figure 1:
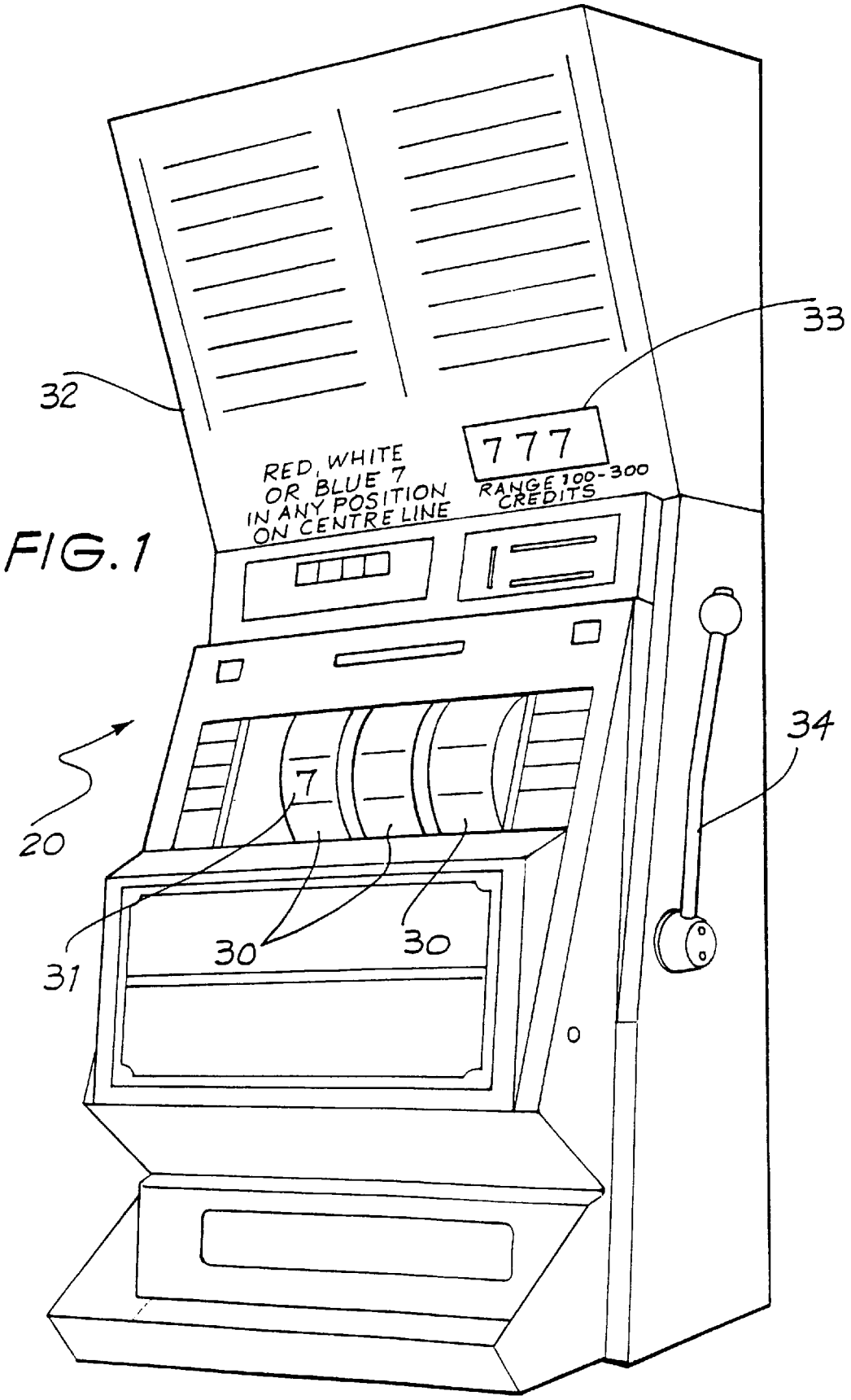
FIG. 1 illustrates a gaming machine with rotating reel display incorporating a first embodiment of the invention.

Referring to FIG. 1 of the drawings, the first embodiment of the invention is illustrated in which a slot machine 20 of the type having a plurality of rotatable reels 30 carrying symbols 31 is arranged to pay a variable prize on the occurrence of a predetermined symbol or combination of symbols. In this embodiment, the predetermined symbol is a white, red or blue 7 appearing in the center line of any reel, however, the invention could equally be implemented such that the variable prize is paid upon the occurrence of three sevens or in fact any other combination of symbols considered by the game designers to be suitable.

In the slot machine 20 illustrated in FIG. 1, the game is initiated by a pull handle 34, however, it will be recognised by persons skilled in the art that this operating mechanism might be replaced by a push button actuator in other embodiments of the invention.

The top box 32 on top of the slot machine 20 displays the various winning combinations for which a prize is paid on this machine, and in particular includes a display window 33 in which is displayed a variable prize value associated with a special winning symbol combination. In the illustrated embodiment the variable prize is paid on the occurrence of a red, white or blue seven and the prize will vary between 100 and 300 credits. During normal operation of the machine the variable prize window will display the value 777, however, on the occurrence of a blue, white or red seven in any centreline position, the display will change to show the current variable prize payable.

The variable prize may be calculated as a random number or alternatively it may be calculated using a formula based on pay history of the machine in which the feature is fitted, such that the percentage return of the machine may be regulated, by paying larger variable prizes when the payout history of the machine has been low and smaller variable prizes when the payout history of the machine has been high.

Figure 2:
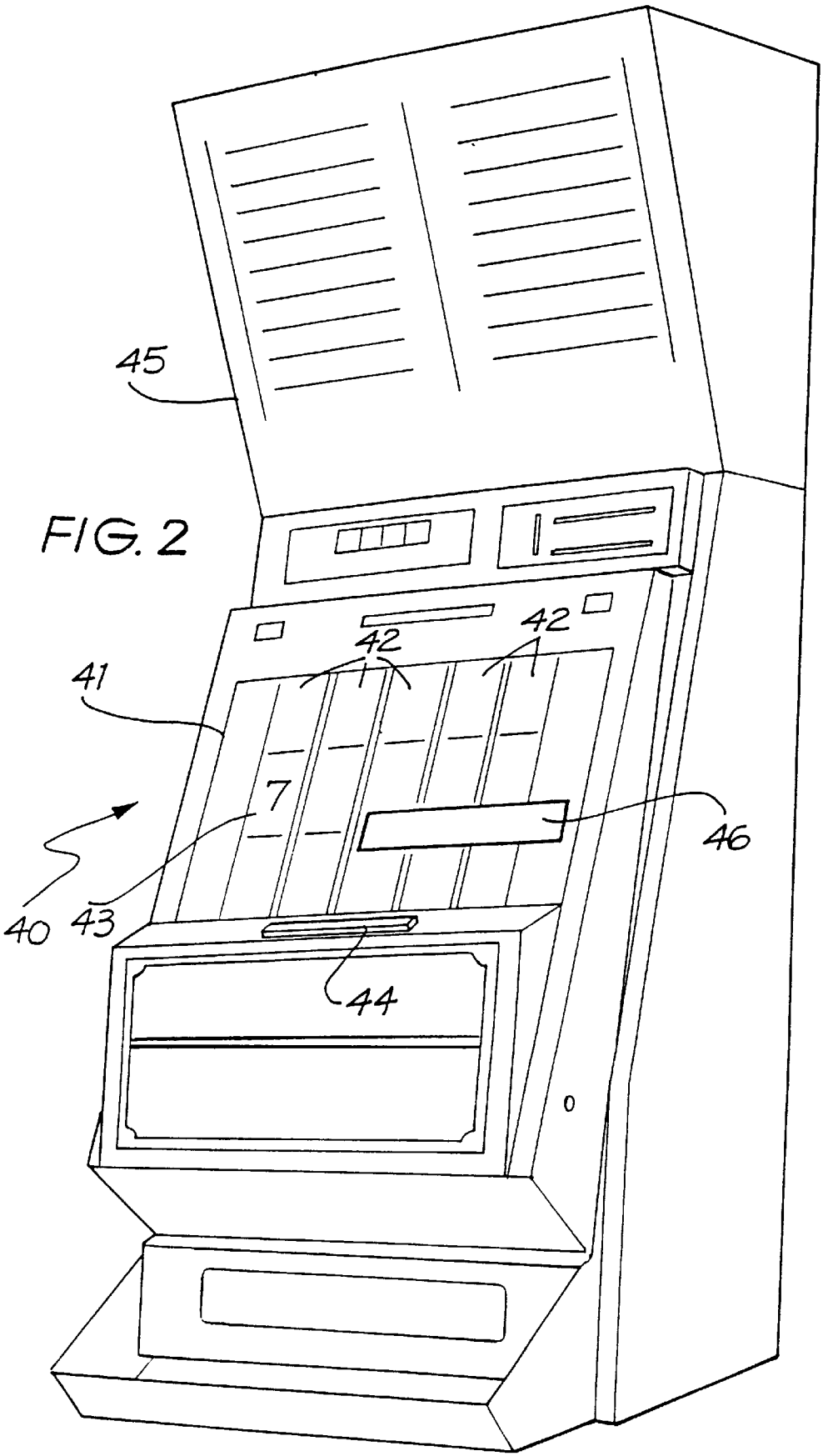
FIG. 2 illustrates a gaming machine with a video simulation of a rotating reel display incorporating the first embodiment of the invention.

Turning to FIG. 2, a video version of the embodiment of FIG. 1 is illustrated, in which a slot machine 40 is provided with a video screen 41 on which spinning reels 42 are simulated, each of the spinning reels having a plurality of symbols 43 similar to the physical symbols in the embodiment of FIG. 1. Games on this machine are initiated by operation of a button 44 below the video screen.

The top box 45 again carries information about prize winning combinations and in this instance would include information about the variable prize but not the prize window 33 of FIG. 1. Rather, the prize is displayed in a psuedo window 46 provided on the video screen if and when a variable prize is achieved.

Figure 3:
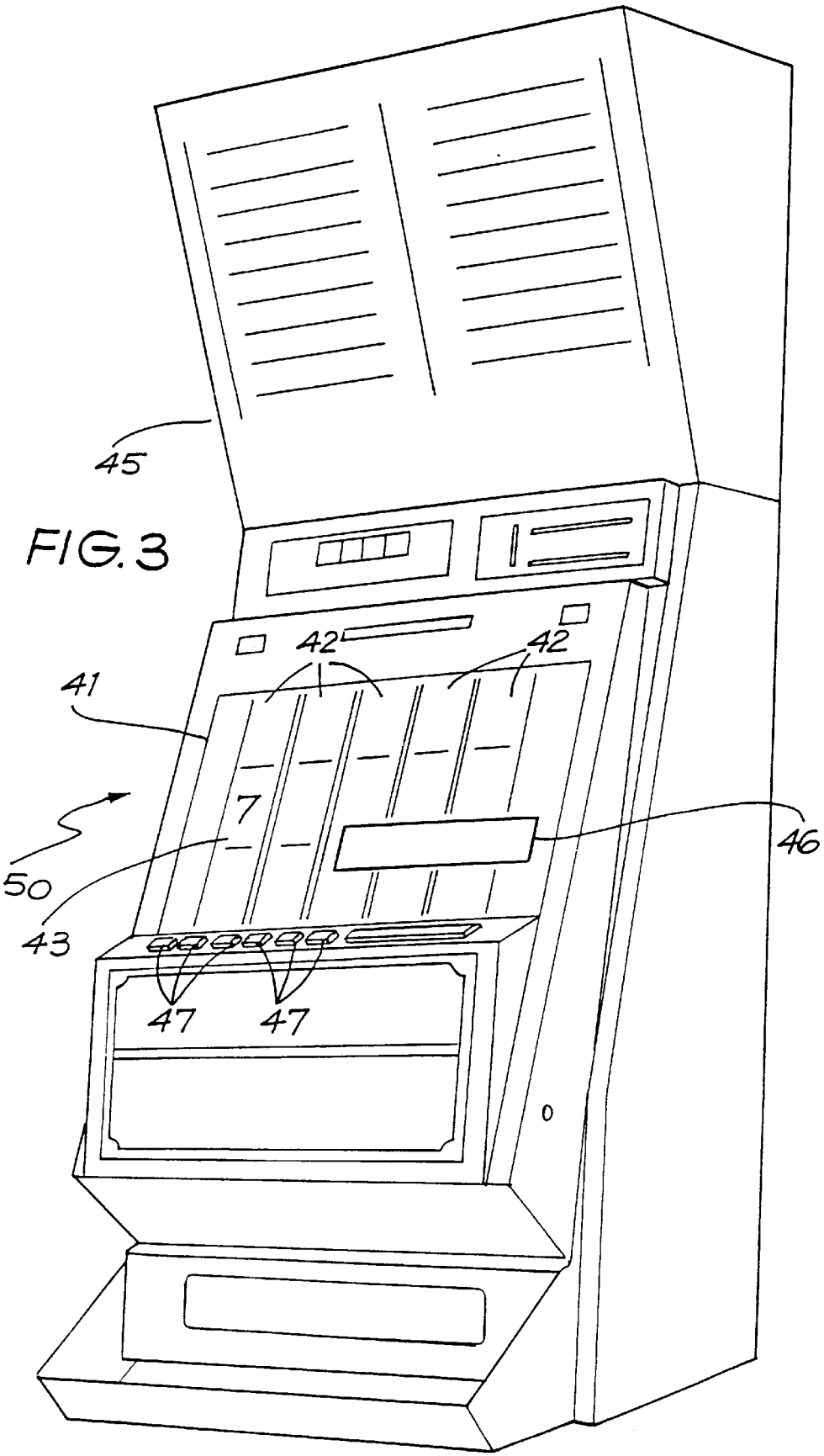
FIG. 3 illustrates a gaming machine with a video simulation of a rotating reel display incorporating a second embodiment of the invention.
Figure 4:
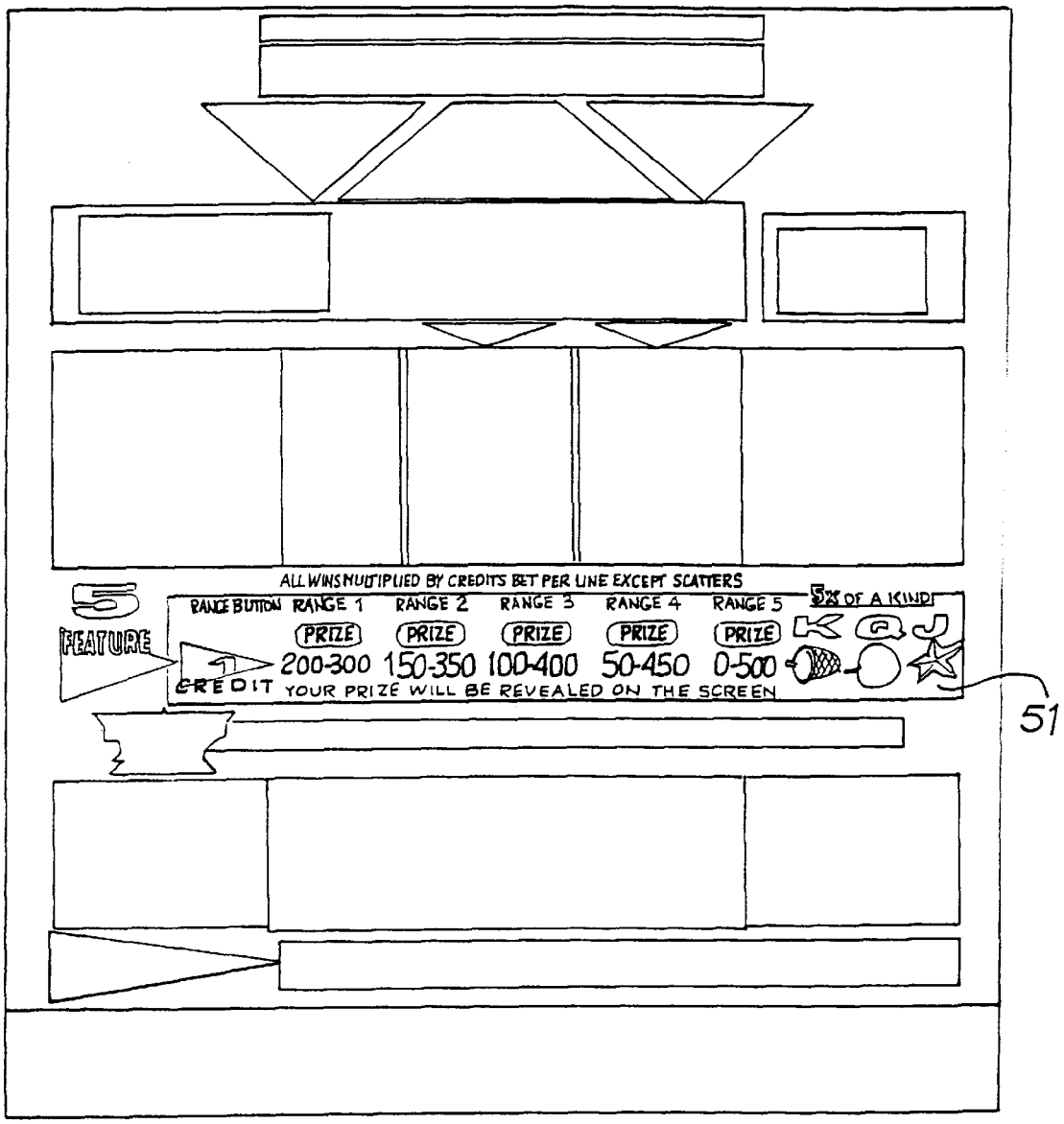
FIG. 4 illustrates a score card artwork for the embodiment of FIG. 3.

The embodiment of FIG. 3 is similar to that of FIG. 2 except that the actuating button 44 is moved to one side of the control panel and a series of function switches 47 are provided, some of which are used for selection of a prize range by the player. This embodiment of the invention has a top box artwork as illustrated in FIG. 4, on which a number of variable prize ranges 51 are provided, such that the player may select the risk that they wish to take. In the embodiment illustrated in FIGS. 3 and 4 these ranges are 200–300 credits; 150–350 credits; 100–400 credits; 50–450 credits and 0–500 credits. However clearly other combinations of ranges are possible and would be selected depending on the statistics relevant to the particular machine. The switches 47 on the control panel are used by the player to select the desired range and having selected this range the variable prize will be calculated in a similar manner to that used in the earlier described embodiments, with the exception that it will fall within the range selected by the player.

Figure 5:
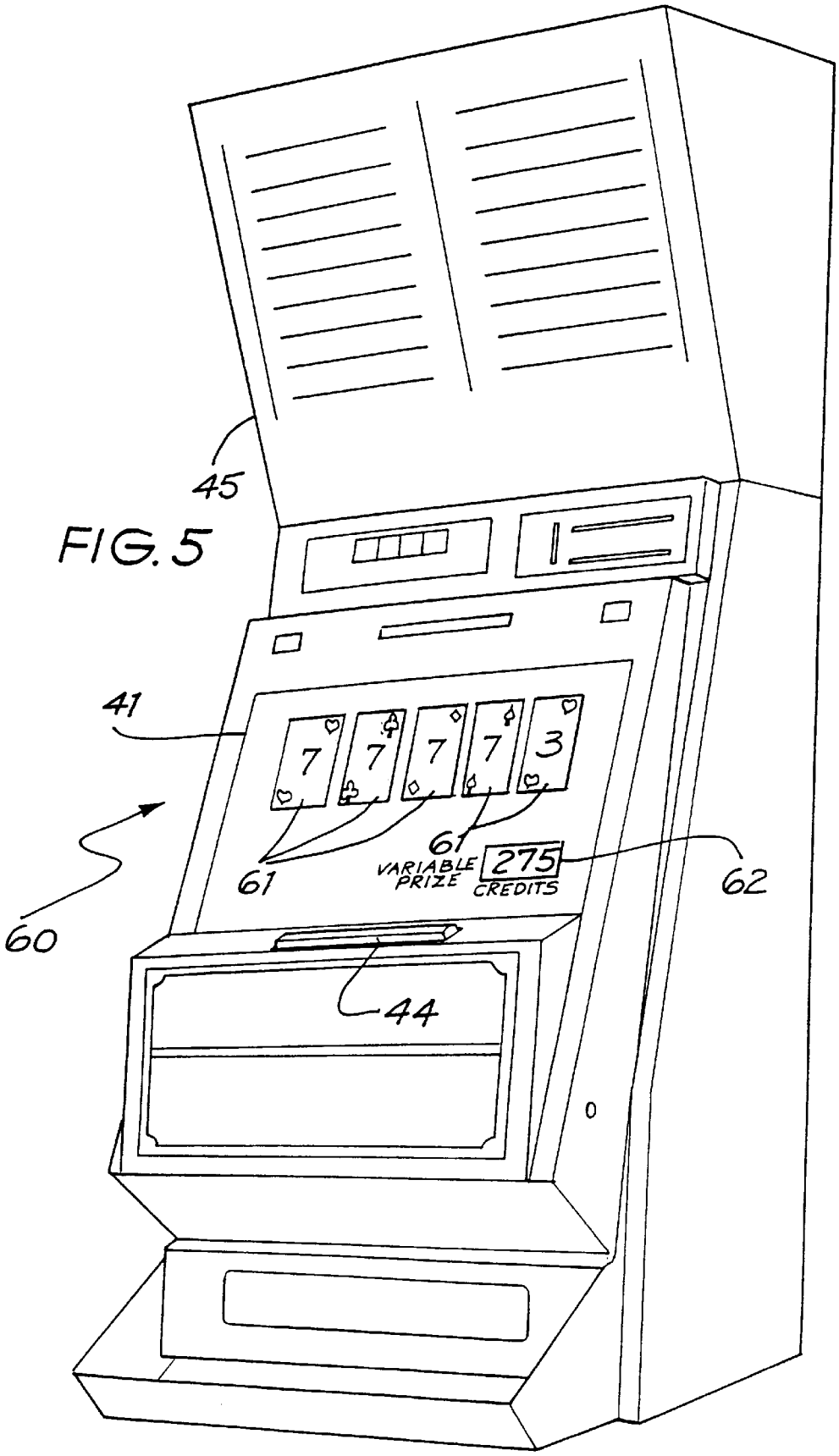
FIG. 5 illustrates a video draw poker machine incorporating an embodiment of the invention.

While the embodiments described to this point have been for gaming machines of the type having rotating reels or simulated rotating reels, the invention is equally applicable to draw poker machines an example of which is illustrated in FIG. 5. In this embodiment the draw poker machine 60 is again provided with a video screen 41 on which are displayed five cards 61 drawn from a deck of 52 or 53 cards. The prizes displayed on the top box 45 relate to standard poker hands, however, the variable prize feature of the present invention may also be provided either on a combination which is a standard winning poker hand or some other combination selected specifically for this prize value. For example, the prize might again be paid on the occurrence of a seven in any position on the screen or alternatively it may be paid for four sevens, a straight or a flush.

In this instance again, the variable prize is displayed in a window 62 provided on the video screen, with the variable prize only being visible when a prizewinning combination has occurred, at other times the window either not being displayed or being displayed with an out of range number.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A gaming machine having display means, and game control means arranged to control images displayed on the display means, the game control means being arranged to play a game wherein a plurality of symbols are randomly selected and displayed on the display means and, if a winning combination of displayed symbols results, the machine pays a prize; and wherein the gaming machine is provided with variable prize display means arranged to display a value of a variable prize whose value is within a predetermined prize range, and when the randomly selected symbols displayed on the display means includes a predetermined symbol or combination of symbols, the control means selects a prize value from within the predetermined range and simultaneously with, or after the displaying of the randomly selected symbols, the control means causes the selected prize value to be displayed on the display means and the gaming machine pays the selected prize value.

2. The gaming machine of claim 1 wherein the display means includes rotatable reels carrying the plurality of symbols.

3. The gaming machine of claim 2 wherein the variable prize is paid when a particular predetermined symbol is displayed in the combination or hand.

4. The gaming machine as claimed in claim 2 wherein the variable prize is paid for a particular predetermined combination of symbols or cards.

5. The gaming machine as claimed in claim 2 wherein the variable prize is selected by the machine from a fixed range of values.

6. The gaming machine as claimed in claim 2 wherein the machine includes variable value selection means, operatively connected to the control means, for enabling a person playing the machine to select, from a set of predefined prize value ranges, a prize value range to be used as the predetermined prize range for the next game and to indicate to the control means the selected prize range.

7. The gaming machine as claimed in claim 2 wherein an auxiliary display is provided to display the variable prize value.

8. The gaming machine of claim 7 wherein the auxiliary display is a liquid crystal display built into the score card artwork.

9. The gaming machine of claim 1 wherein the display means includes a video display arranged to simulate a plurality of rotatable reels carrying a plurality of symbols.

10. The gaming machine as claimed in claim 9 wherein the variable prize value is displayed in a window on a video display when the predetermined winning symbol or combination is displayed.

11. The gaming machine of claim 3 wherein the variable prize is paid when a particular predetermined symbol is displayed in the combination or hand.

12. The gaming machine as claimed in claim 9 wherein the variable prize is paid for a particular predetermined combination of symbols or cards.

13. The gaming machine as claimed in claim 9 wherein the variable prize is selected by the machine from a fixed range of values.

14. The gaming machine as claimed in claim 9 wherein the machine includes variable value selection means, operatively connected to the control means, for enabling a person playing the machine to select, from a set of predefined prize value ranges, a prize value range to be used as the predetermined prize range for the next game and to indicate to the control means the selected prize range.

15. The gaming machine as claimed in claim 9 wherein an auxiliary display is provided to display the variable prize value.

16. The gaming machine of claim 9 wherein the auxiliary display is a liquid crystal display built into the score card artwork.

17. The gaming machine as claimed in claim 16 wherein the variable prize value is displayed in a window on a video display when the predetermined winning symbol or combination is displayed.

18. The gaming machine of claim 1 wherein the display means includes a video display arranged to display a hand of a card game.

19. The gaming machine of claim 4 wherein the card game is draw poker.

20. The gaming machine of claim 18 wherein the variable prize is paid when a particular predetermined symbol is displayed in the combination or hand.

21. The gaming machine as claimed in claim 18 wherein the variable prize is paid for a particular predetermined combination of symbols or cards.

22. The gaming machine as claimed in claim 18 wherein the variable prize is selected by the machine from a fixed range of values.

23. The gaming machine as claimed in claim 18 wherein the machine includes variable value selection means, operatively connected to the control means, for enabling a person playing the machine to select, from a set of predefined prize value ranges, a prize value range to be used as the predetermined prize range for the next game and to indicate to the control means the selected prize range.

24. The gaming machine as claimed in claim 18 wherein an auxiliary display is provided to display the variable prize value.

25. The gaming machine of claim 24 wherein the auxiliary display is a liquid crystal display built into the score card artwork.

26. The gaming machine as claimed in claim 18 wherein the variable prize value is displayed in a window on a video display when the predetermined winning symbol or combination is displayed.

27. The gaming machine of claim 1 wherein the variable prize is paid when a particular predetermined symbol is displayed in the combination or hand.

28. The gaming machine as claimed in claim 1 wherein the variable prize is paid for a particular predetermined combination of symbols or cards.

29. The gaming machine as claimed in claim 1 wherein the variable prize is selected by the machine from a fixed range of values.

30. The gaming machine as claimed in claim 1 wherein the machine includes variable value selection means, operatively connected to the control means, for enabling a person playing the machine to select, from a set of predefined prize value ranges, a prize value range to be used as the predetermined prize range for the next game and to indicate to the control means the selected prize range.

31. The gaming machine as claimed in claim 1 wherein an auxiliary display is provided to display the variable prize value.

32. The gaming machine of claim 31 wherein the auxiliary display is a liquid crystal display built into the score card artwork.

* * * * *